US007350902B2

(12) United States Patent
Dietl et al.

(10) Patent No.: US 7,350,902 B2
(45) Date of Patent: Apr. 1, 2008

(54) FLUID EJECTION DEVICE NOZZLE ARRAY CONFIGURATION

(75) Inventors: Steven J. Dietl, Ontario, NY (US); Steven A. Billow, Pittsford, NY (US); William E. Bland, Cardiff-by-the Sea, CA (US); James M. Chwalek, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 330 days.

(21) Appl. No.: 10/992,311

(22) Filed: Nov. 18, 2004

(65) Prior Publication Data

US 2006/0103691 A1 May 18, 2006

(51) Int. Cl.
*B41J 2/21* (2006.01)

(52) U.S. Cl. ..... 347/43; 347/40

(58) Field of Classification Search ..... 347/43, 347/98, 15, 40, 42, 12, 96, 65
See application file for complete search history.

(56) References Cited

U.S. PATENT DOCUMENTS 5,030,971 A 7/1991 Drake et al.
5,412,410 A 5/1995 Rezanka
5,570,118 A 10/1996 Rezanka et al.
6,030,065 A 2/2000 Fukuhata
6,293,647 B2 * 9/2001 Saijo ..... 347/24
6,315,389 B1 * 11/2001 Torgerson et al. ..... 347/40
6,592,203 B1 7/2003 Bates et al.
6,869,166 B2 * 3/2005 Brugue et al. ..... 347/49
2003/0202045 A1 * 10/2003 Torgerson et al. ..... 347/43
2004/0138337 A1 * 7/2004 Hasegawa et al. ..... 523/160

FOREIGN PATENT DOCUMENTS

EP 1 356 938 10/2003

* cited by examiner

*Primary Examiner*—Lamson Nguyen
(74) *Attorney, Agent, or Firm*—William Bland; William R. Zimmerli

(57) ABSTRACT

A fluid ejection device and a printhead including one or more such fluid ejection devices are provided. The fluid ejection device includes a substrate having a first nozzle array and a second nozzle array, each array having a plurality of nozzles and being arranged along a first direction, the first nozzle array being arranged spaced apart in a second direction from the second nozzle array. A first fluid delivery pathway is in fluid communication with the first nozzle array, and a second fluid delivery pathway is in fluid communication with the second nozzle array. Nozzles of the first nozzle array have a first opening area and are arranged along the first nozzle array at a pitch P. Nozzles of the second nozzle array have a second opening area, the second opening area being less than the first opening area. At least one nozzle of the second array is arranged offset in the first direction from at least one nozzle of the first array by a distance which is less than pitch P. A printhead comprises one or more such fluid ejection devices arranged on a support member.

48 Claims, 13 Drawing Sheets

FLUID EJECTION DEVICE NOZZLE ARRAY CONFIGURATION

FIELD OF THE INVENTION

The present invention relates, generally, to fluid ejection systems and, more particularly, to fluid ejection devices associated with these systems.

BACKGROUND OF THE INVENTION

Ink jet printing systems are one example of digitally controlled fluid ejection devices. Ink jet printing systems are typically categorized as either drop-on-demand printing systems or continuous printing systems.

Drop-on-demand printing systems incorporating a heater in some aspect of the drop forming mechanism are known. Often referred to as "bubble jet drop ejectors" or "thermal ink jet drop ejectors", these mechanisms include a resistive heating element(s) that, when actuated (for example, by applying an electric current to the resistive heating element(s)), vaporize a portion of a fluid contained in a fluid chamber creating a vapor bubble. As the vapor bubble expands, liquid in the liquid chamber is expelled through a nozzle orifice. When the mechanism is de-actuated (for example, by removing the electric current to the resistive heating element(s)), the vapor bubble collapses allowing the liquid chamber to refill with liquid.

In a thermal ink jet printing device, there are typically hundreds of thermal ink jet drop ejectors which are grouped into one or more arrays. Large numbers of drop ejectors are useful for a high degree of addressability for high resolution printing, as well as for high throughput printing. In a color printing system, different arrays of drop ejectors are typically used to print at least cyan, magenta and yellow ink.

Thermal ink jet printheads may be classified as either face-shooting devices or edge-shooting devices. In both types of configurations the resistive heating elements are formed, typically together with driving and addressing electronics, at or near the planar surface of a substrate such as a silicon die. In a face-shooting device, the drop of liquid is ejected perpendicular to the plane of the substrate. Face-shooting devices include both roofshooters and backshooters. In a roofshooting device the direction of ink ejection is the same as the direction of bubble growth. In a backshooter, the direction of ink ejection is opposite the direction of bubble growth. In an edge-shooting device, the drop is ejected in a direction which is substantially parallel to the plane of the substrate. In a face-shooting device nozzle orifices may be readily formed in a two-dimensional configuration. In an edge-shooting device the orifices are typically arranged within a single line along the edge of the device.

Within a high resolution, high throughput printer there may be a plurality of printheads or silicon substrates to provide the multiple nozzle arrays that are needed. For example, in a color printer there may be four separate printheads for printing cyan, magenta, yellow and black inks. For excellent image quality, it is necessary to align the corresponding spots from different arrays. For the case of separate printheads, it is generally necessary to perform a subsequent alignment for suitable image quality. Some of the alignment is typically done mechanically, for example by physical contact of the printheads with reference surfaces provided within the printer. Electronic compensation for printhead misalignment may also be done in the printer. For example, a print test pattern may be used in order to select which nozzles from the different arrays should correspond to one another for best alignment, and in order to set the relative timing of the firing of the printheads.

One solution for alignment of different arrays of nozzles is to fabricate all of the arrays on the same silicon die. U.S. Pat. No. 5,030,971 describes a printhead having a heating element substrate with at least two ink inlets and corresponding arrays of nozzles and their associated heating elements. In such a configuration, the ink inlets may be used such that each feeds a different color of ink. In a different application they may all feed a single ink color. In addition, the nozzles on either side of an ink inlet may be staggered with respect to each other so that double the addressable printing resolution is provided. '971 also discloses that if the plurality of ink inlets feed the same type of ink, and if the nozzle arrays are also offset by a fraction of the nozzle spacing with respect to each other, then even higher addressable printing resolution is possible.

An approach similar to '971 of providing multiple staggered linear arrays of nozzles for high single pass printing resolution is also described in U.S. Pat. No. 6,543,879.

Arrays which are formed on the same silicon die are made with the high precision inherent in photolithography and microelectronic fabrication processes, which provides sufficient alignment. However, in some applications, forming all of the required arrays on one die may cause the die size to grow so large that it is too costly.

One alternative is to bond a plurality of silicon die to a common support member. The relative alignment between arrays on different die which are bonded to the same substrate is not as precise as within a single die (e.g. within 1 micron), but a fairly high degree of alignment precision (e.g. within 10 microns) may still be built into the printhead using such an approach.

An example of bonding a plurality of thermal ink jet die onto a common support member is a pagewidth array. Most thermal ink jet products at present are carriage-style printers and are comprised of die with printing array lengths of about 1 to 3 cm. These arrays are typically scanned across the paper (substantially perpendicular to the array length) in order to print a swath. Then the paper is advanced in a direction parallel to the array length so that the printheads can print the next swath. In a pagewidth array printer, drop ejection nozzles are provided across the entire width of a page, so that it is not necessary to have relative movement between the printhead and paper along the direction of the array length. Due to fabrication yield, it may be prohibitively expensive to make high quality printing arrays which are comprised of a single die, which would need to be at least 20 cm long. Instead, a pagewidth printhead is assembled by bonding a plurality of die on a common support member. For pagewidth printheads the N die are positioned such that the combined array length is approximately N times the array length on a given die. The die may be positioned end to end, or in staggered fashion. For the staggered configuration, some overlap of the printing areas of neighboring die is possible, so that the overall array length is a little less than N times the individual array length.

For some carriage-style printer applications it is also advantageous to bond multiple die to the same support member. U.S. Pat. No. 6,659,591 describes the construction of a printhead having a first roofshooting die with ink inlets and ejectors for cyan, magenta and yellow ink, and a second roofshooting die with ink inlet and ejectors for black ink. Both die are bonded to the same support member. In such a printhead, the die are typically bonded with the nozzle arrays substantially parallel with one another, rather than in endto-end fashion. The motivation for multiple die on a substrate in such an application is compactness of the printing unit, as well as some degree of built-in precision alignment.

In some printing applications it is useful to have different groups of drop generating elements, such that each group is designed to eject droplets of a particular drop size. The nominal drop volume for a given thermal ink jet drop ejector depends mainly on design parameters such as heater area, nozzle orifice area and chamber geometry, and also somewhat upon properties of the fluid being ejected. Thermal ink jet drop generators are capable of providing only a somewhat limited range of variation of drop size by methods such as modifying the current pulse train to the resistive heating elements. Therefore in applications where it is desired to do gray scale printing by deposition of different volumes of ink on each pixel site, it is useful to provide a plurality of nozzle arrays such that the drop generators in each array prints a given drop volume, which is different from the drop volume ejected by drop generators in a different array. U.S. Pat. No. 4,746,935 discloses a printhead where three drop generators in a row are weighted to provide drop volumes in a ratio of 1:2:4. The row of different sized drop generators is parallel to the scanning direction of the printhead during printing, so that by proper timing of the firing, droplets from each of the three different sized drop ejectors can land in the same location on the paper. Different combinations of drop sizes printed on the same pixel site can provide up to 8 different levels of ink coverage.

U.S. Pat. No. 5,412,410 discloses an edge-shooter type thermal ink jet printhead in which two groups of nozzles are collinearly arranged where the nozzles from first group are equally spaced in alternating fashion with nozzles from the second group. Nozzles from the two groups produce different drop sizes. By proper timing of the firing of the second group of nozzles relative to the first group, it is possible to position small drops at the interstices between large drops using such a nozzle configuration. In the configuration disclosed, the small drops would be the same ink type as the large drops. A disadvantage of multiple groups of nozzles arranged on an edgeshooter is that the nozzle resolution is limited by the requirement that all of the nozzles be arranged in a single line.

U.S. Pat. No. 6,592,203 discloses a printhead having a line of nozzles of one size disposed in alternating fashion with a second line of nozzles which is parallel to the first line of nozzles and having a different nozzle size. In the method of printing which is disclosed in this patent, columns of pixel locations are arranged on the print media. In a first set of columns of pixel locations, a large dot of a given ink type may be printed in the first pixel location. In a second set of columns of pixel locations, which are interleaved with the first set of columns, a small dot of the same ink type would be available to be printed. This is made possible by gearing the paper advance with a resolution of double the resolution of the nozzles.

As discussed above, in a printing system it is sometimes advantageous to provide different sized drop ejectors so that at least one ink may be selectively ejected with different drop volumes. In addition, it is sometimes useful to provide different sized drop ejectors corresponding to the different liquids that are being ejected. Some ink types have different spreading properties on the print media than others. For example, color inks are sometimes designed to penetrate rapidly into uncoated papers (so that adjacent printed colors do not bleed into one another), while the black ink may be designed to penetrate slowly into such papers. This allows the black ink to spread more controllably, without undesirable wicking along paper fibers, so that black text can be clear and crisp. In such a printing system, it would be desirable for the black drop ejectors to eject a larger drop volume than the color drop ejectors in order to enable full coverage of the paper.

U.S. Pat. No. 5,570,118 discloses a color printing system in which two different black inks are printed with two different printheads. The first black printhead ejects ink having a high surface tension (greater than 40 dynes/cm) so that it does not spread rapidly and is suitable for sharp edges on lines and text. This first black printhead is separated by a small gap from a set of secondary printheads for ejecting cyan, magenta, yellow and a second type of black ink. Each of the inks in the secondary printheads has a surface tension less than 40 dynes/cm. Low surface tension inks tend to penetrate into the paper more rapidly and are less likely to bleed into adjacent regions of printed ink of a different color. The intent is to use the secondary printheads for printing color portions of the image, and the first black printhead for printing portions of the image containing only black. One drawback of this configuration where the two different arrays of black drop ejectors are on separate printheads is that it is difficult to align the separate printheads such that the spots from different black arrays are precisely positioned with respect to one another with an alignment error of less than one pixel spacing.

SUMMARY OF THE INVENTION

According to one aspect of the present invention, a fluid ejection device includes a substrate having a first nozzle array and a second nozzle array, each array having a plurality of nozzles and being arranged along a first direction, the first nozzle array being arranged spaced apart in a second direction from the second nozzle array. A first fluid delivery pathway is in fluid communication with the first nozzle array, and a second fluid delivery pathway is in fluid communication with the second nozzle array. Nozzles of the first nozzle array have a first opening area and are arranged along the first nozzle array at a pitch P. Nozzles of the second nozzle array have a second opening area, the second opening area being less than the first opening area. At least one nozzle of the second array is arranged offset in the first direction from at least one nozzle of the first array by a distance which is less than pitch P.

According to another aspect of the present invention, a printhead comprises one or more such fluid ejection devices arranged on a support member. A fluid source is in fluid communication with each of the first and second fluid delivery pathways of each of the fluid ejection devices. A drop forming mechanism is operatively associated with each of a plurality of nozzles of the first nozzle array and each of a plurality of nozzles of the second nozzle array.

DETAILED DESCRIPTION OF THE INVENTION

The invention is described below in terms of printing applications. However, in general the fluid ejection device of the present invention is generally useful in applications where it is desired to eject droplets of fluid from arrays of nozzles having two different opening areas, such that the ejected droplets are designed to land in precise registration with one another but with a slight offset between droplets from the two different nozzle sizes, and furthermore where either a similar or a distinct fluid may be ejected from the larger nozzles as compared with the fluid ejected by the smaller nozzles. As such, in addition to printing, the invention may be useful in fields relating to biomedical applications, chemical analysis, or microfabrication by successive deposition of droplets of materials. Many other applications are emerging which make use of devices similar to inkjet print heads, but which emit fluids (other than inks) that need to be finely metered and deposited with high spatial precision. Even within a printing application, it may be desirable to eject a fluid which is not an ink used for recording information. As such, as described herein, the term fluid refers to any material that can be ejected by the fluid ejection device described below.

Figure 1:
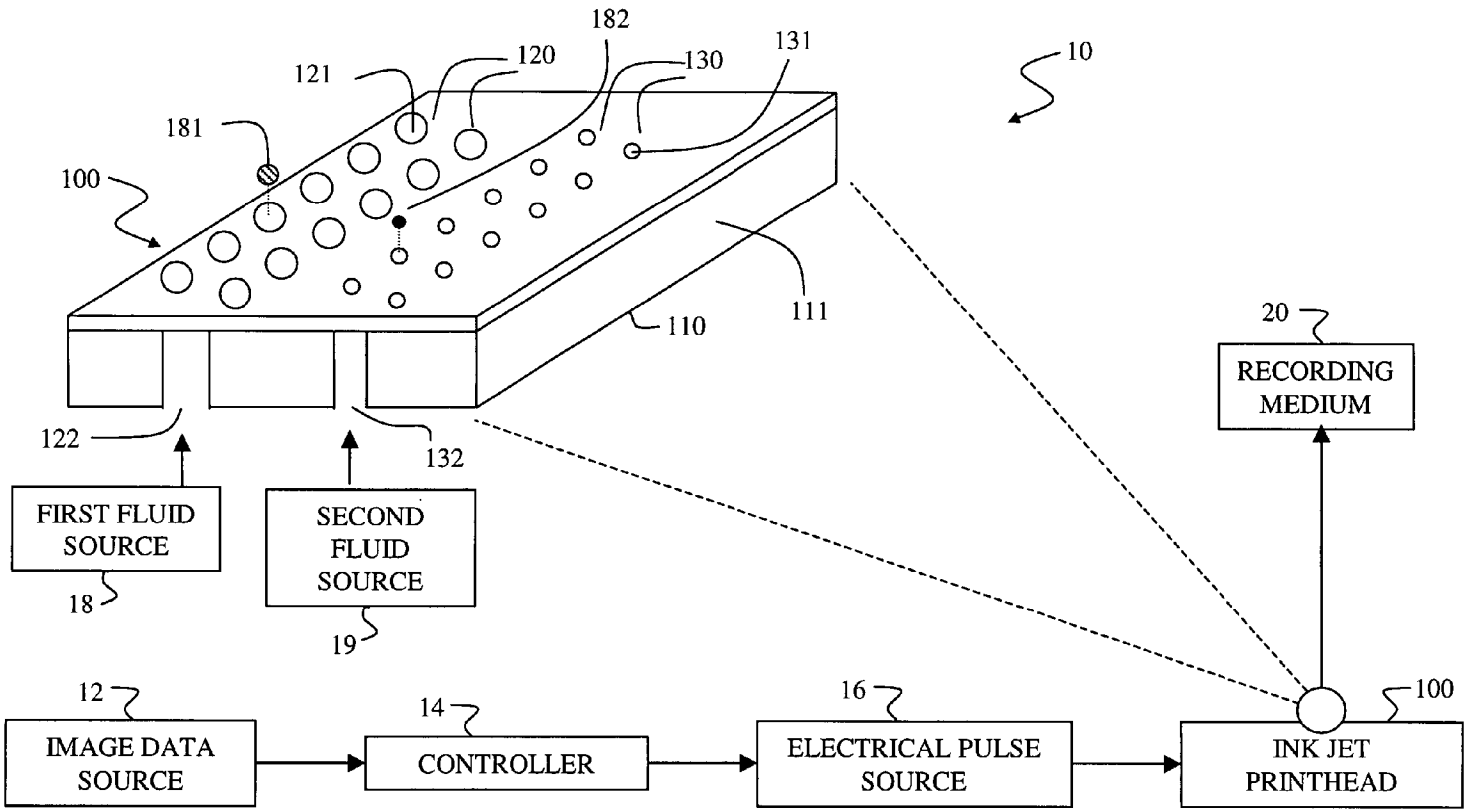
FIG. 1 is a schematic illustration of a fluid ejection system incorporating a fluid ejection device according to this invention.

Referring to FIG. 1, a schematic representation of a fluid ejection system 10, such as an inkjet printer, is shown. The system includes a source 12 of data (say, image data) which provides signals that are interpreted by a controller 14 as being commands to eject drops. Controller 14 outputs signals to a source 16 of electrical energy pulses which are inputted to the fluid ejection subsystem 100, for example, an inkjet print head which is comprised of at least one fluid ejection device 110. The various embodiments of this invention are of the type where the fluid ejection device has a plurality of nozzle arrays and a plurality of corresponding fluid delivery pathways. In the example shown in FIG. 1, there are two nozzle arrays. Nozzles 121 in the first nozzle array 120 have a larger opening area than nozzles 131 in the second nozzle array 130. The nozzle arrays are formed on substrate 111. In fluid communication with each nozzle array is a corresponding fluid delivery pathway. Fluid delivery pathway 122 is in fluid communication with nozzle array 120, and fluid delivery pathway 132 is in fluid communication with nozzle array 130. Portions of fluid delivery pathways 122 and 132 are shown in FIG. 1 as openings through substrate 111. One or more fluid ejection devices will be included in fluid ejection subsystem 100, but only fluid ejection device 110 is shown. The device or devices are arranged on a support member which is also not shown. Fluid is supplied to the fluid delivery paths. In FIG. 1, first fluid source 18 supplies fluid to first nozzle array 120 via fluid delivery pathway 122, and second fluid source 19 supplies fluid to second nozzle array 130 via fluid delivery pathway 132. Although distinct fluid sources 18 and 19 are shown, in some applications it may be beneficial to have a single fluid source supplying fluid to nozzle arrays 120 and 130 via fluid delivery pathways 122 and 132 respectively. Not shown in FIG. 1 are the drop forming mechanisms associated with the nozzles. Drop forming mechanisms can be of a variety of types, some of which include a heating element to vaporize a portion of fluid and thereby cause ejection of a droplet, or a piezoelectric transducer to constrict the volume of a fluid chamber and thereby cause ejection, or an actuator which is made to move (for example, by heating a bilayer element) and thereby cause ejection. In any case, electrical pulses from pulse source 16 are sent to the various drop ejectors according to the desired deposition pattern. Droplets 181 ejected from nozzle array 120 are larger than droplets 182 ejected from nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of fluid, for example, ink, are deposited on a recording medium 20.

Figure 2A:
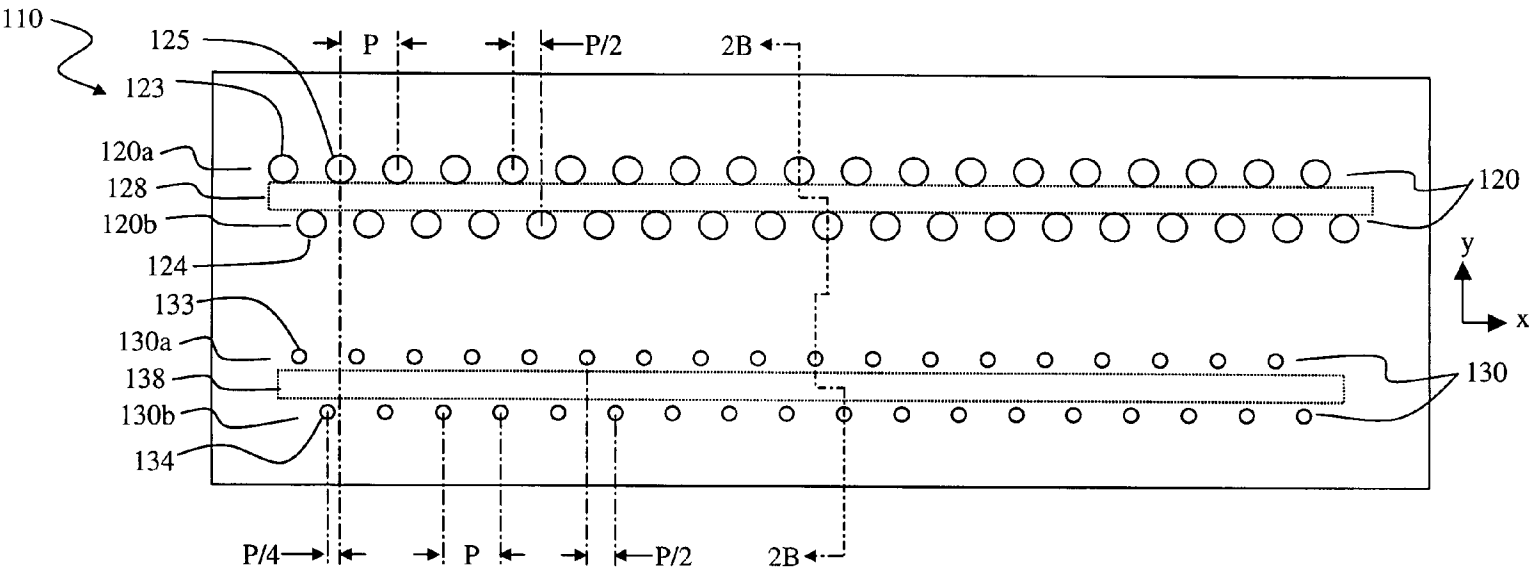
FIG. 2A is a top view of a fluid ejection device with two offset nozzle arrays having different opening areas and corresponding slot-fed fluid delivery pathways.

FIG. 2 shows a first embodiment of a fluid ejection device 110 of this invention. Fluid delivery slots 128 and 138 are formed through substrate 111. The fluid delivery slots extend along the length of the substrate in the x direction, each slot thereby forming a channel to supply fluid to the nozzles arranged along its respective length. Nozzle array 120 is composed of two groups of nozzles. Nozzle group **120*a* is arranged along one side of fluid delivery slot 128 and nozzle group 120*b* is arranged along the other side of slot 128. Nozzle groups 130*a* and 130*b* are similarly arranged with respect to fluid delivery slot 138. Nozzle array 120 is spaced apart from nozzle array 130 in the y direction. Nozzles in each subgroup are shown as being arranged in a straight line in the x direction. In some applications, adjacent nozzles within each subgroup may be designed with a slight offset in the y direction, for example arranged in a sawtooth pattern. Generally speaking, the nozzles are arranged along the fluid delivery slots, substantially in a straight line in the x direction. Nozzles in group 120*a* are arranged at pitch P. In other words, adjacent nozzles in group 120*a*, such as nozzles 123 and 125, are a distance P apart in the x direction. In the configuration shown in FIG. 2A, nozzles in group 120*b* are also spaced at pitch P, and so are nozzles in groups 130*a* and 130*b*. Nozzles in group 120*b* are offset in the x direction by an amount P/2 with respect to corresponding nozzles in group 120*a*. As seen from left to right in nozzle array 120, the first nozzle is 123 from group 120***a*, the second nozzle is 124 from group 120*b* (and is a distance P/2 away from nozzle 123 in the x direction), and the third nozzle is 125 from group 120*a* (and is a distance P/2 away from nozzle 124 in the x direction). By staggering groups 120*a* and 120*b* (each having pitch P), a fluid ejection device is provided with a first nozzle array which is capable of ejecting droplets with centers a distance P/2 apart in the x direction. There are similar spacings for the nozzles in group 130. In addition, in the configuration of FIG. 2A, the nozzles of group 130 are offset in the x direction by a distance P/4 from the nozzles of group 120. From left to right in fluid ejection device 110, the first nozzle is 123, the second is 133, the third is 124, the fourth is 134, and the fifth is 125. Thus, from left to right, the nozzles in the fluid ejection device alternate between nozzles of larger opening area from array 120 and nozzles of smaller opening area from array 130. The distance along x between two successive nozzles on fluid ejection device 110 is P/4.

In many applications it is desirable to have the opening area of nozzles in group 120*a* be the same as the opening area of nozzles in group 120*b*, but in some applications it may be desirable to have nozzles in group 120*a* with different opening area than those in group 120*b*. The same is true of nozzles in groups 130*a* and 130*b*.

Figure 2B:
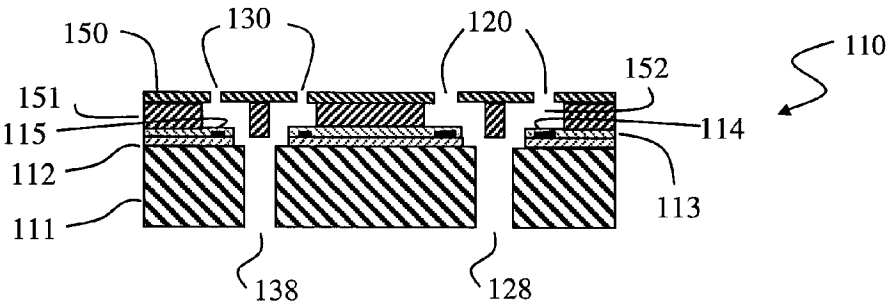
FIG. 2B is a cross-sectional view as seen along broken line 2B-2B.

FIG. 2B shows a fluid ejection device 110 in cross-section. A plurality of layers is formed on substrate 111. The number of layers and the function of each layer differs for various fluid ejector types. There may be an isolation layer 112 directly over substrate 111. There are one or more layers 113 which form the drop generator (that is, the drop forming mechanism) and associated protective material. In FIG. 2B, the drop generators are shown as resistive heaters such as heater 115 corresponding to a nozzle in array 130, and heater 114 corresponding to a nozzle in array 120. One or more chamber-forming layers 151 are patterned to provide chambers (such as 152) to contain the fluid near the drop generator. Over the chamber forming layer or layers is the nozzle plate layer 150, in which are patterned the nozzle arrays. Typically there is a nozzle for each chamber. The fluid delivery pathway 122 supplying fluid to nozzle array 120 consists of the slot 128 in substrate 111, plus any passageways in the layers on the substrate leading to the fluid chambers for nozzle array 120.

FIG. 2 shows the nozzles arranged at uniform spacing within an array. In some applications there may be a primary set of nozzles in the array which carry out the main function (such as printing), and a secondary set of nozzles in the array which carry out different functions. These secondary nozzles may be provided in order to carry out various maintenance functions, such as removing air from the device. The secondary nozzles may be formed to reduce end-effects in fabrication or drop ejection. The secondary nozzles may have different opening area than those in the primary array, and they may also be arranged at different spacings. The secondary nozzles may be connected to the fluid delivery pathway in some applications, while in other applications they may not be connected. The secondary nozzles may or may not have drop forming mechanisms associated with them. For applications where there are no secondary nozzles, all nozzles may be considered to be primary nozzles.

In many printing applications it is desirable for the primary nozzles corresponding to a particular printing fluid to be arranged at a uniform pitch. In other applications it may be desirable to introduce some nonuniformity in the spacing of the nozzles along the array. In such a case, the nozzle pitch may be defined as the average nozzle spacing along the array.

Figure 3:
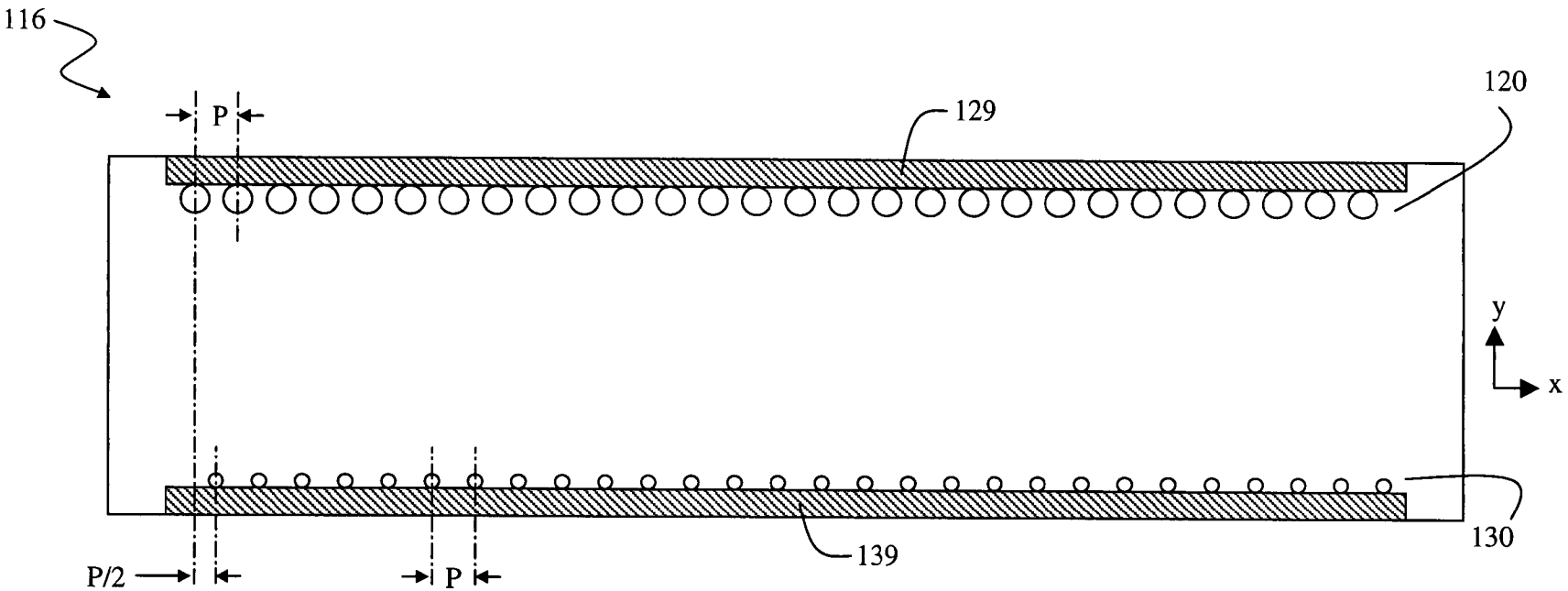
FIG. 3 is a top view of a fluid ejection device with two offset nozzle arrays having different opening areas and corresponding edge-fed fluid delivery pathways.

FIG. 3 shows a second embodiment of a fluid ejection device 116 of this invention. In this embodiment the fluid pathway for nozzle array 120 goes around a long edge of the substrate, leading to channel 129 which extends along the x direction and supplies fluid to the array. Nozzles in array 120 are spaced at pitch P along one side of channel 129. The nozzles in array 130 are arranged similarly with respect to fluid channel 139 which is on the opposite long edge of the substrate. Nozzles in array 130 are spaced at pitch P and are also offset in the x direction from corresponding nozzles in array 120 by a distance P/2. Thus, from left to right, the nozzles in the fluid ejection device alternate between nozzles of larger opening area from array 120 and nozzles of smaller opening area from array 130. The distance along x between two successive nozzles on fluid ejection device 110 is P/2.

Figure 4:
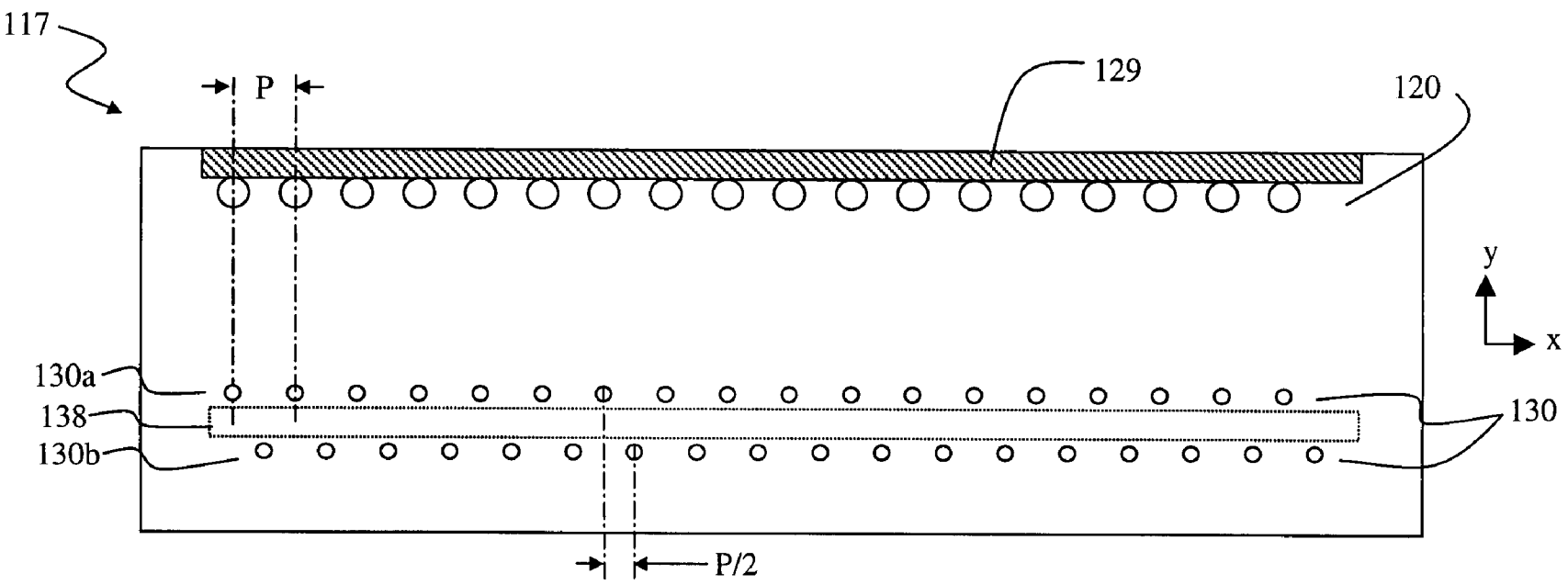
FIG. 4 is a top view of a fluid ejection device with two offset nozzle arrays having different opening areas, one array being slot-fed and the other being edge-fed.

FIG. 4 shows a third embodiment of a fluid ejection device 117 of this invention. In this embodiment, nozzles in the first array 120 are supplied with fluid around the edge of the substrate, as in FIG. 3, while nozzles in the second array 130 are supplied with fluid from a slot in the substrate, as in FIG. 2. Nozzles in array 120 are spaced at pitch P along one side of channel 129. Nozzle array 130 is composed of two groups of nozzles. Nozzle group 130*a* is arranged along one side of fluid delivery slot 138 and nozzle group 130*b* is arranged along the other side of slot 138. Both nozzle groups 130*a* and 130*b* are arranged at pitch P, with nozzles in group 130*a* offset along the x direction from nozzles in group 130*b* by a distance P/2. In the configuration shown in FIG. 4, there is zero offset in the x direction between nozzles in array 120 and nozzles in group 130*a*, while there is an offset of P/2 between nozzles in array 120 and nozzles in group 130*b*. Alternatively (not shown), there could be a nonzero offset between nozzles in array 120 and nozzles in group 130*a* as well as nozzles in group 130*b*. For example, there could be an offset of plus P/4 between nozzles in array 120 and nozzles in array 130*a*, and an offset of minus P/4 between nozzles in array 120 and nozzles in array 130*b*. In many applications it is desirable to have the opening area of nozzles in group 130*a* be the same as the opening area of nozzles in group 130*b*, but in some applications it may be desirable to have nozzles in group 130*a* with different opening area than those in group 130*b*.

Figure 5:
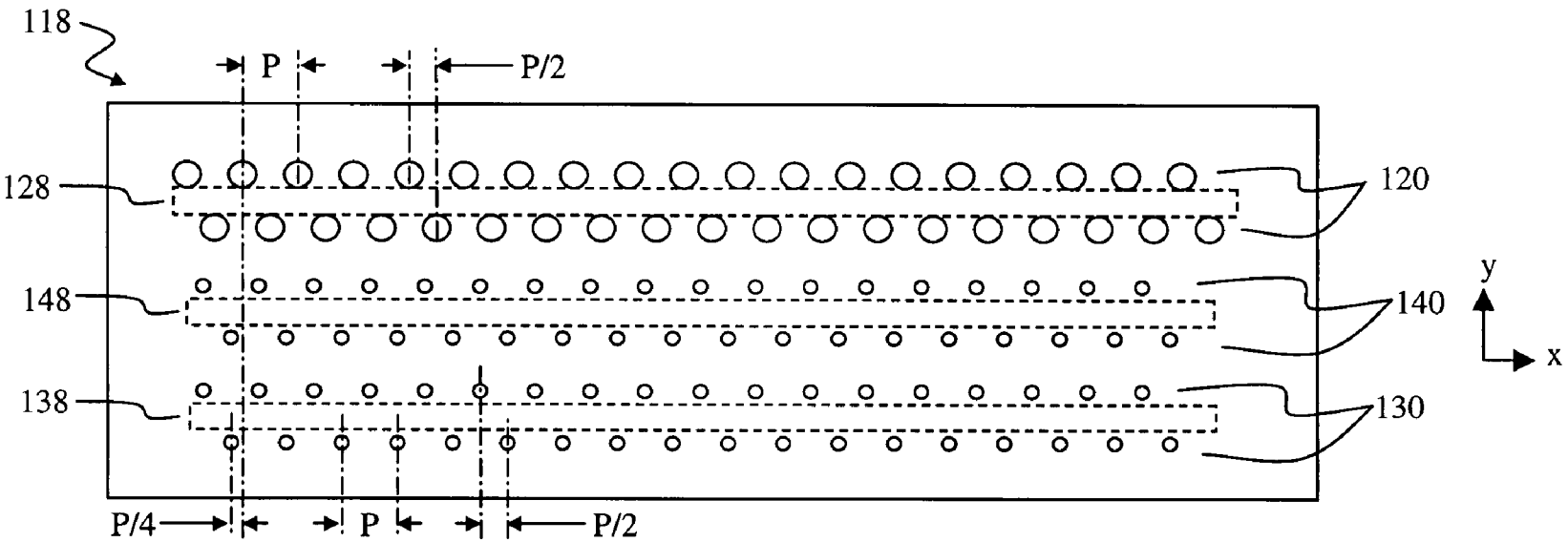
FIG. 5 is a top view of a fluid ejection device with three nozzle arrays, two being offset and having different opening areas, and corresponding slot-fed fluid delivery pathways.

FIG. 5 shows a fourth embodiment of a fluid ejection device 118 of this invention. In this embodiment there are three nozzle arrays 120, 130, and 140, each comprising two groups of nozzles on opposite sides of fluid delivery slots 128, 138 and 148 respectively. For the configuration shown in FIG. 5, nozzles in each group are arranged at pitch P along their respective fluid delivery slots. Nozzles in arrays 130 and 140 have the same opening area and have zero offset with respect to each other in the x direction. Nozzles in array 120 have a larger opening area and are offset from nozzle arrays 130 and 140 by P/4 in the x direction. In alternate embodiments (not shown), nozzles in array 130 may have a different opening area than nozzles in array 140, and optionally may be offset from nozzles in array 140 in the x direction.

Combining one or more fluid ejection devices together with other components such as a support member, means of electrical interconnection, and means of fluid connection, one may make a fluid emitter. A particular type of fluid emitter which will be discussed in detail below is a printhead. However, more generally, fluid emitters may have applications outside the printing field, including biomedical applications, chemical analysis, and microfabrication by deposition of successive layers of droplets.

Figure 6:
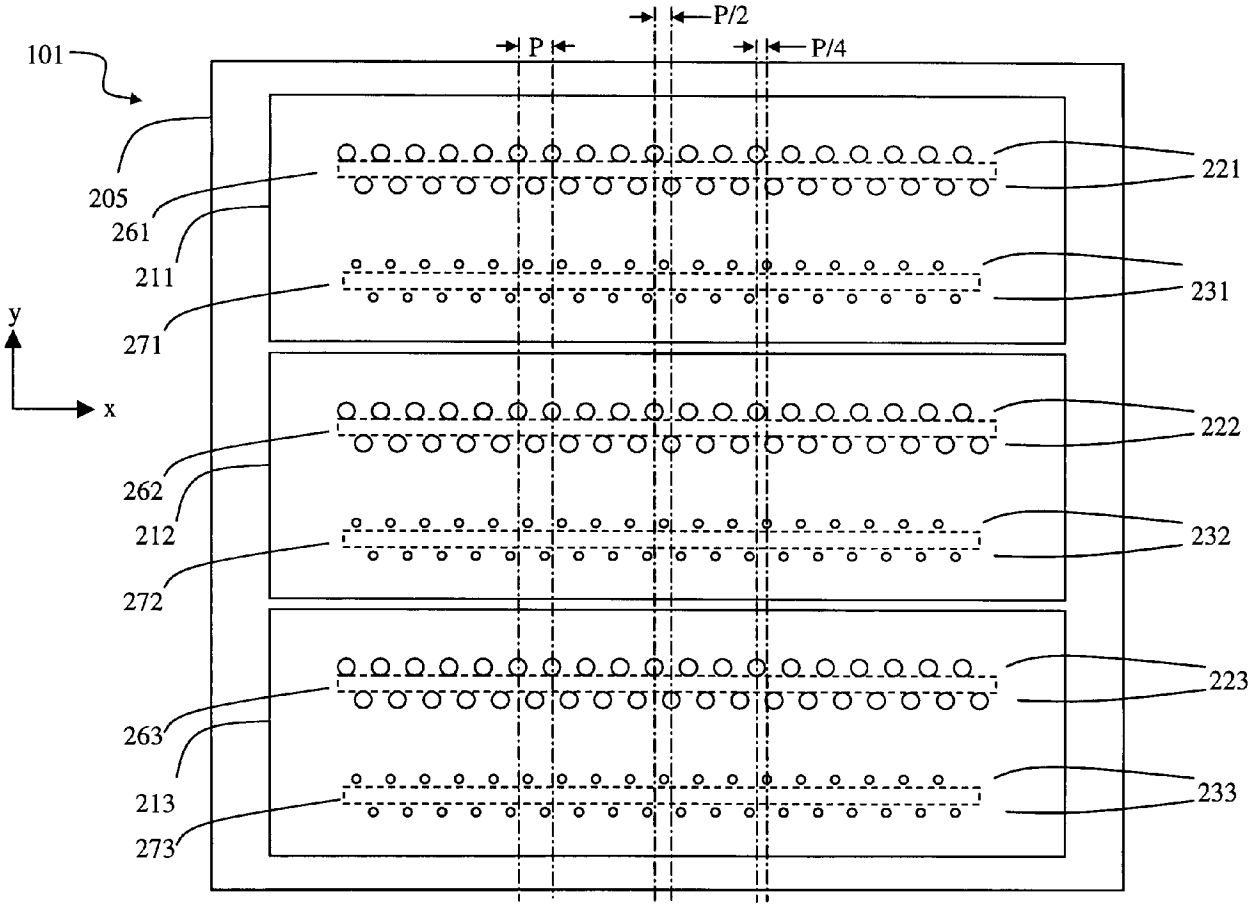
FIG. 6 is a top view of a fluid emitter or printhead with three fluid ejection devices, each with offset nozzle arrays having different opening areas.
Figure 7:
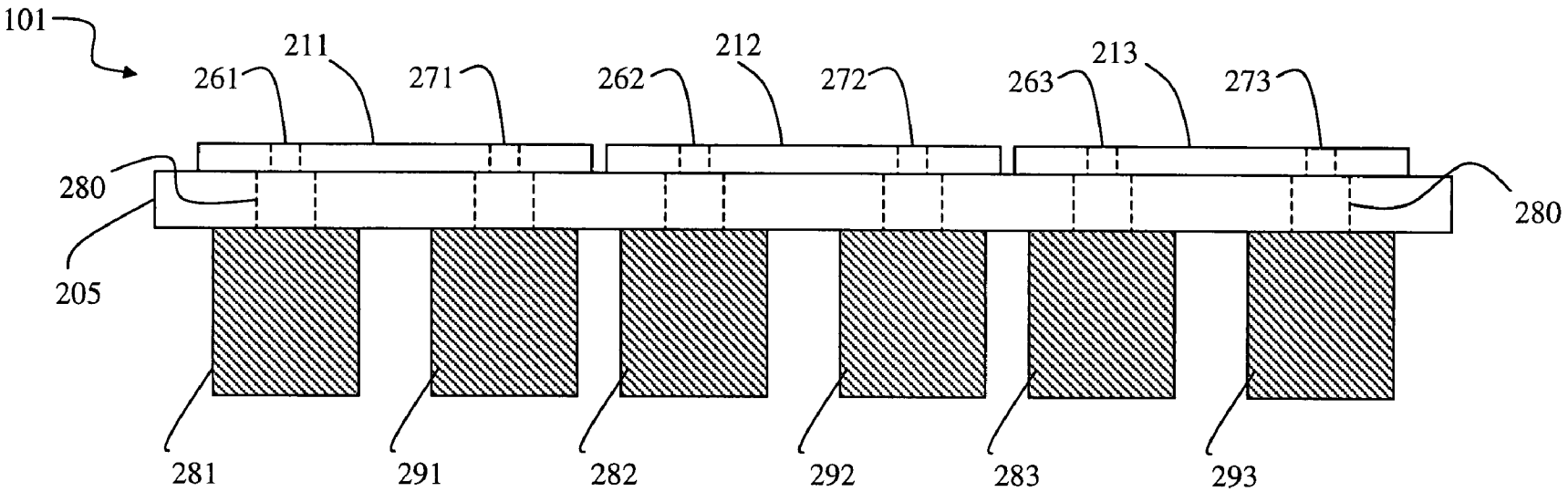
FIG. 7 is a cross-sectional view of an inkjet printhead having three fluid ejection devices mounted on a support member, and respective independent fluid delivery sources.

FIG. 6 shows a top view of a fluid emitter, such as a printhead 101, comprising three fluid ejection devices (211, 212 and 213) of the type 110 shown in FIG. 2 and described above, each having two nozzle arrays where the nozzles in one array have a larger opening area than the nozzles in the other array and the two arrays are offset from one another in the x direction. FIG. 7 shows a cross sectional view of printhead 101. Device 211 contains nozzle arrays 221 and 231 arranged along fluid delivery slots 261 and 271 respectively. Device 212 contains nozzle arrays 222 and 232 arranged along fluid delivery slots 262 and 272 respectively. Device 213 contains nozzle arrays 223 and 233 arranged along fluid delivery slots 263 and 273 respectively. Fluid ejection devices 211, 212 and 213 are all bonded to the same support member 205, offset from one another in the y direction (that is, offset in a direction that is perpendicular to the array direction) and with a small gap between neighboring devices. In some applications, it is desirable to have zero offset in the x direction between corresponding nozzles on the different fluid ejection devices, as shown in FIG. 6. In other applications, it may be desirable to have some offset in the x direction between the fluid ejection devices. The fluid ejection devices are held fixedly in place on support member 205, so that their relative alignment is preserved. Support member 205 also has fluid delivery pathways associated with it which direct fluid from the fluid sources to the fluid delivery slots in the fluid ejection devices. In the printhead 101 configuration shown in FIG. 7, support member 205 has six fluid delivery holes 280. By means of the fluid delivery holes 280, fluid source 281 is in fluid communication with fluid delivery slot 261 of device 211, and similarly for fluid sources 291, 282, 292, 283 and 293 with respective fluid delivery slots 271, 262, 272, 263 and 273. Fluid-tight seals (not shown) are provided between respective holes in support member 205 and the corresponding fluid delivery slots in the fluid ejection devices. FIG. 6 is primarily intended to illustrate the nozzle configuration and does not show other printhead features such as drop forming mechanisms or means of electrical interconnection.

Fluid sources such as 281, 282, 283, 291, 292 and 293 supplying a printhead such as printhead 101 may be integrally and permanently attached to the printhead. In such a case, the fluid sources may optionally be refilled when the fluid is depleted. Alternatively, the fluid sources may be removable from the printhead. In such a case, when the fluid is depleted from the fluid source, the depleted source or tank may be removed, and be replaced by a source or tank which is full.

Figure 8:
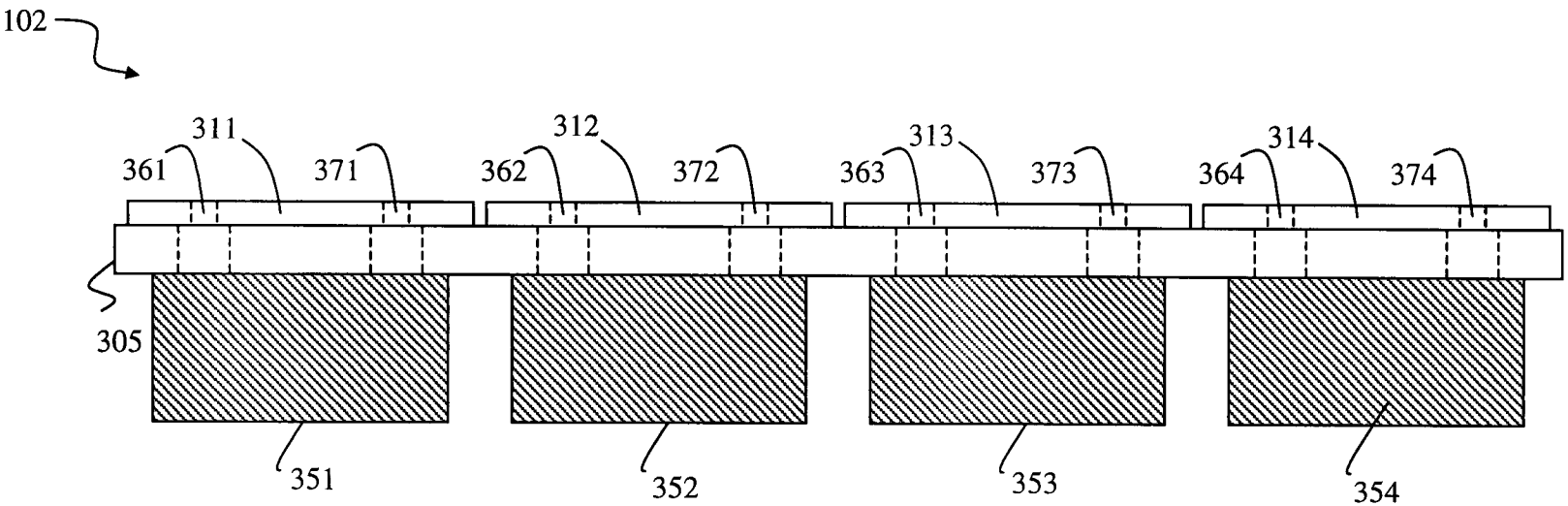
FIG. 8 is a cross-sectional view of an inkjet printhead having four fluid ejection devices mounted on a support member, and respective combined fluid delivery sources.
Figure 9:
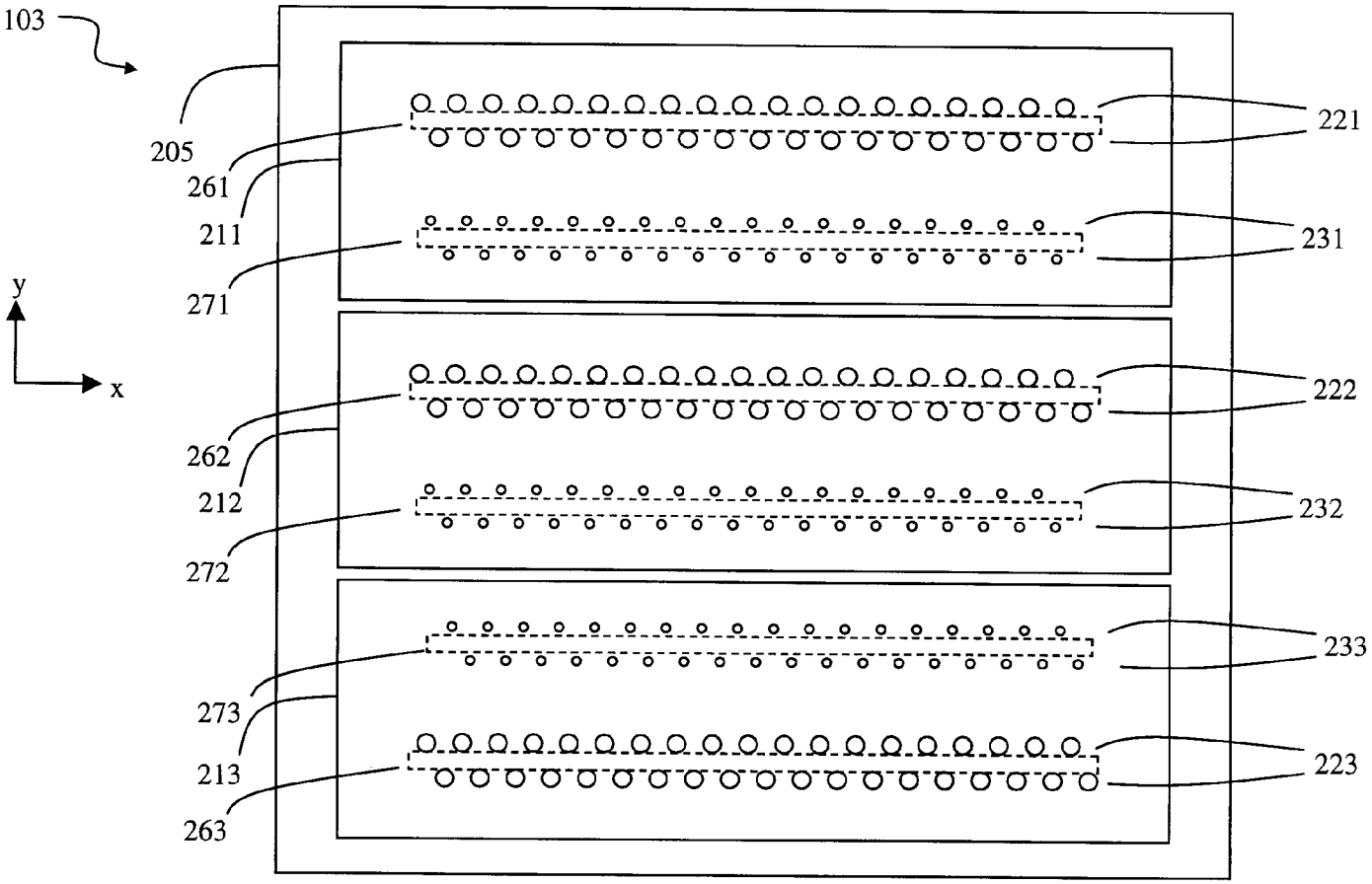
FIG. 9 is a top view of a fluid emitter or printhead with three fluid ejection devices, each with offset nozzle arrays having different opening areas, one device being rotated.

In many applications it is economically advantageous to make printheads having a plurality of nominally identical fluid ejection devices, such as is shown in FIG. 6. By designing printheads using such a building-block approach, the fluid ejection devices may be made at high yield and in large volumes consistent with low cost fabrication. In addition, different products may be made using the same fluid ejection devices as building blocks. For example, one type of printhead may be as exemplified by printhead 101 of FIG. 7 with three fluid ejection devices of the type shown in FIG. 2, each having independent fluid sources connected to each of the fluid delivery pathways. A second type of printhead may be as exemplified by printhead 102 of FIG. 8, with four fluid ejection devices of the type shown in FIG. 2, where a single fluid source 351 supplies both fluid delivery slots 361 and 371 on device 311; and similarly fluid source 352 supplies both slots on device 312, fluid source 353 supplies both slots on device 313, and fluid source 354 supplies both slots on device 314. Various other configurations are also possible, including a printhead (not shown) with four fluid ejection devices of the type shown in FIG. 2, each having independent fluid sources to each of the fluid delivery pathways. While FIG. 6 shows all three nominally identical devices with equivalent orientation, with the larger nozzles on each fluid ejection devices being closer to the top of the figure, it is also possible to rotate one of the devices by 180 degrees so that the larger nozzles are toward the bottom of the figure for that device, as in printhead 103 shown in FIG. 9. Rather than alternating arrays large nozzles and small nozzles across the printhead, two arrays of small nozzles 232 and 233 from fluid ejection devices 212 and 213 respectively are located adjacent to one another.

Although in many applications it is preferable to use a plurality of the same type of fluid ejection device to make the printhead, it is also possible to use dissimilar devices. For example, in a printhead where it is desired to have two arrays of large nozzles and three arrays of smaller nozzles, another printhead configuration (not shown) uses one fluid ejection device of the type 110 shown in FIG. 2 and one fluid ejection device of the type 118 shown in FIG. 5.

In the type of printhead such as shown in FIG. 7 where different fluid sources are provided for each of the fluid delivery pathways for each fluid ejection device, it is possible to supply a fluid to the array having larger nozzles which is distinctly different from the fluid which is supplied to the array having smaller nozzles. The distinctly different fluids may have different colorants. Distinctly different fluids may alternatively have the same nominal color, but have differing fluid compositions so as to have different physical properties such as surface tension or viscosity.

As an example, consider a printhead 101 of the type shown in FIGS. 6 and 7, where a colorless fluid is supplied to slot 261, magenta ink is supplied to slot 271, yellow ink is supplied to slot 262, cyan ink is supplied to slot 272, black ink optimized for text printing (for example, by having higher surface tension) is supplied to slot 263, and black ink optimized for color images (for example, by having lower surface tension) is supplied to slot 273. Such a printhead may be used in a printing product where it is desired to print high quality black text as well as high quality photographic images. Black text would generally be printed using the high surface tension ink supplied to the larger nozzles in nozzle array 223 through slot 263. Color images, including photographs, would be printed using magenta, cyan and lower surface tension black inks supplied to smaller nozzles in nozzle arrays 231, 232 and 233 respectively, plus yellow ink supplied to larger nozzles in nozzle array 222. In some printing applications, it may be desirable to print solid area black using both the larger nozzles of nozzle array 223, plus the smaller nozzles of nozzle array 233, in order to fill the interstices between drops printed by nozzle array 223. Because the nozzle arrays for both black inks are formed on the same fluid ejection device 213, the nozzle arrays are aligned very accurately with respect to one another. Alignment between different colors is not quite as critical, and the required alignment can be readily achieved by attaching the three fluid ejection devices to the same support member.

Colorless fluid supplied to slot 261 may be one of a variety of types. It can be a dilutive fluid so that the intensity of colorant at the surface can be modified by adding a droplet of colorless fluid to a pixel location with one or more colored drops. It can be a penetrating fluid, which can help inks wick into the paper more rapidly. It can be a fluid which reacts with one or more of the other fluids, for example facilitating a curing or fixing or precipitation of one of the other fluids which is ejected by the fluid emitter or printhead. It can be a protective fluid, which can help to provide a more durable image. Co-pending applications "Using Inkjet Printer to Apply Protective Ink" (docket 87531) and "Inkjet Printing Using Protective Ink" (docket 87493) provide additional background information on printing using protective ink.

Printheads of the type 101 shown in FIG. 6 typically do not have a wide enough printing region to cover the entire image region on the recording medium 20 in a single pass. When used in a carriage style printer, such printheads are scanned in the y direction with respect to the medium during a printing pass. Then the recording medium is advanced in the x direction relative to the printhead, and printing is continued on a second pass in the opposite direction. In some printing modes, the amount that the recording medium is advanced is substantially equal to the length of the nozzle arrays. In other printing modes, the recording medium is advanced only a fraction of the length of the nozzle array, for example, approximately half the length of the nozzle array. In this way printing defects can be disguised, by printing adjacent pixel regions using nozzles from different parts of the printhead. For such printing modes, it may be advantageous to be able to print the entire amount of fluid required in a single pass for the larger nozzle arrays 221, 222, and 223, while perhaps requiring two passes for full coverage of the smaller nozzle arrays 231, 232 and 233. For example, for a colorless fluid which is a protective fluid, it may be advantageous to deposit the protective fluid last in a single unidirectional pass. It may also be beneficial to position the array of large nozzles which eject protective fluid to be at an extreme end of the printhead, as is the case for array 221 being the topmost array in the printhead 101 of FIG. 6. Optimal relative size of the droplets ejected from the larger nozzle arrays and smaller nozzle arrays depends on the details of the fluids being ejected, but in many applications, it will be preferred that the ratio of drop volumes between large nozzles and small nozzles be between 1.3 and 5.0.

In the example described, one of the inks used in color printing is printed using an array of larger nozzles, while the other inks are printed using smaller nozzles. This ink to be printed using larger nozzles is preferably the yellow ink. Yellow spots on paper are less visually perceivable than are cyan spots, magenta spots or black spots. Good image quality may be achieved, even with the mismatch in sizes between the yellow spots and the other color spots.

Although some applications require distinctly different fluids to be ejected from the nozzle arrays on the same fluid ejection devices, other applications may use identical fluid sources for the different nozzle arrays on at least one of the fluid ejection devices. For example, consider a printhead 102 of the type shown in FIG. 8 where black ink is supplied from fluid source 351, cyan ink is supplied from fluid source 352, magenta ink is supplied from source 353 and yellow ink is supplied from fluid source 354. Each of the four colors may then be printed using a matrix of large spots, with smaller spots at the interstices, providing capability for a smoother gradation of tones, as well as better control of printed edges.

For yet other applications, it is desirable to print similar fluids from the large and small nozzle arrays on the same fluid ejection device. For example, it may be desirable to print an ink having a relatively high density of colorant with the larger nozzles, and an ink having similar ink components, but having a lower density of colorant with the smaller nozzles. This will provide capability for an even smoother gradation of tones. In such a case, individual fluid sources for each array would be required, as in the configuration of FIG. 7. When using individual fluid sources, the similar fluids supplied to the larger nozzles and smaller nozzles on a fluid ejection device can in fact be nominally identical.

While colorants of cyan, magenta, yellow and black are adequate to provide the image quality required in many printing applications, other colorants are useful in some applications, for example to extend the color gamut. In such applications, additional nozzle arrays may be provided to a printhead of the type shown in FIG. 6 by additional fluid ejection devices (not shown), and supplying them with ink sources such as green or orange or blue. Other fluid sources with different type colorants which may be used include fluorescent inks which are not very visible unless illuminated under special conditions or wavelengths outside the visible range.

Colorants for the fluid sources may be dye type or pigment type. Both types are compatible with this invention. For pigment inks, the particle size of the pigment can affect the jetting reliability. For smaller nozzle opening area it can be advantageous to have a smaller pigment particle size.

Figure 10:
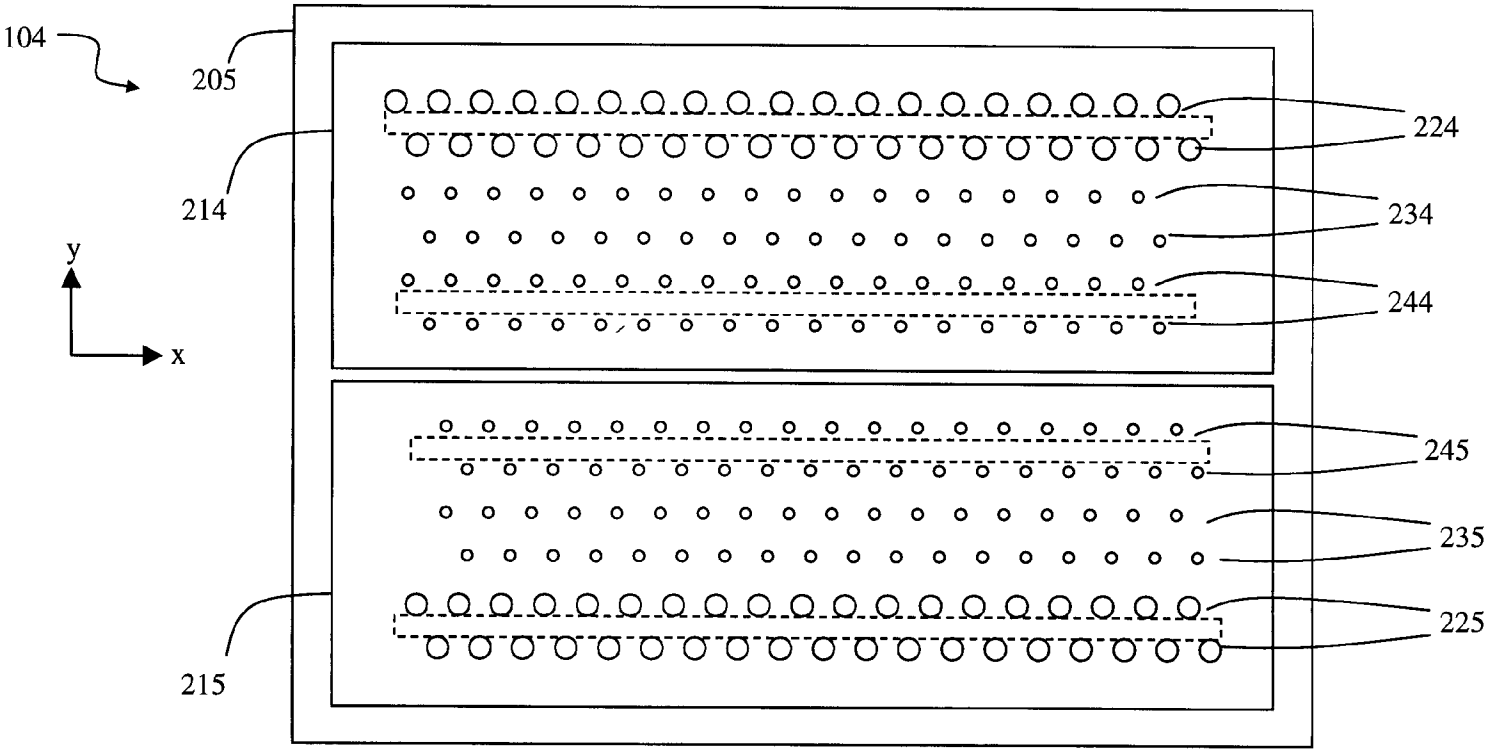
FIG. 10 is a top view of a fluid emitter or printhead with two fluid ejection devices, each with three nozzle arrays, two of which have different opening areas.

The printhead configurations shown in FIGS. 6-9 are of the type comprising a plurality of fluid ejection devices each having two nozzle arrays with corresponding fluid delivery pathways, where the first nozzle array has larger nozzles and the nozzles are offset in the x direction from those in the second nozzle array. Printheads may also be made comprising a plurality of fluid ejection devices, having additional nozzle arrays and corresponding fluid delivery pathways. FIG. 10 shows a printhead 104 composed of two fluid ejection devices 214 and 215, each having three nozzle arrays and bonded to support member 205. In the configuration shown in FIG. 10, fluid ejection devices 214 and 215 are of the type shown in FIG. 5. Fluid ejection device 214 includes nozzle array 224 having larger nozzles, as well as nozzle arrays 234 and 244 having smaller nozzles. The nozzles in arrays 234 and 244 are of the same size and are not offset from one another in the x direction, but both are offset in the x direction from nozzle array 224. Nozzles in each of the arrays are arranged along their corresponding fluid delivery pathway at the same pitch. Fluid ejection device 215 is shown in FIG. 10 to be the same as 214, but rotated by 180 degrees. Printhead 104 of FIG. 10 is similar to printhead 103 of FIG. 9 in that each printhead has six nozzle arrays and corresponding fluid sources. However, while printhead 104 has four arrays of small nozzles, printhead 103 has three arrays of small nozzles.

There are many other variations of printhead 104 which are contemplated but not shown. Some of these many variations include the following. Nozzle arrays 244 may optionally have nozzles which are of different sizes from those in nozzle array 234, and may optionally be offset from them in the x direction. Not all of the nozzle arrays need to be on the same pitch. One or more of the nozzle arrays may be edge-fed with fluid, rather than slot-fed. Fluid ejection device 215 need not be rotated by 180 degrees. There may be additional fluid ejection devices besides 214 and 215 on support member 205.

Figure 11:
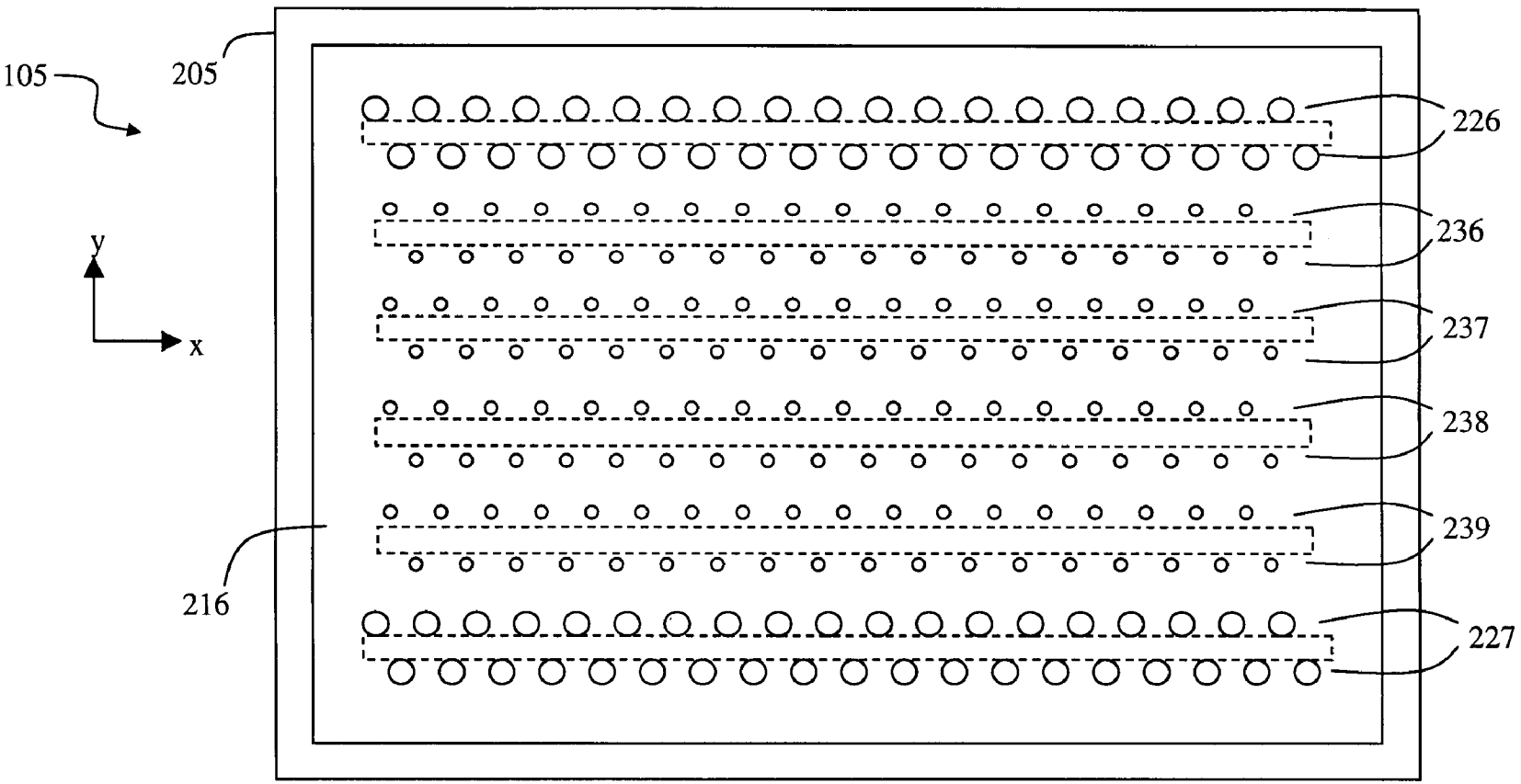
FIG. 11 is a top view of a fluid emitter or printhead with one fluid ejection devices, having six nozzle arrays, some of which are offset and have different opening areas.

FIG. 11 shows another example of a printhead 105 contemplated by this invention. Printhead 105 consists of a single fluid ejection device 216 mounted on support member 205. Fluid ejection devices 216 includes at least a first nozzle array, such as 226, having larger nozzle sizes, and at least a second nozzle array such as 236 having smaller nozzle sizes, where each nozzle array has a corresponding fluid pathway and where an array such as 236 with smaller nozzles is offset in the x direction from the first nozzle array 226 by a distance less than the pitch of the first array. In FIG. 11, two arrays of larger nozzles (226 and 227) as well as four arrays of smaller nozzles (236, 237, 238 and 239) are shown. Each of these arrays is arranged along its corresponding fluid delivery pathway at the same pitch.

Figure 12:
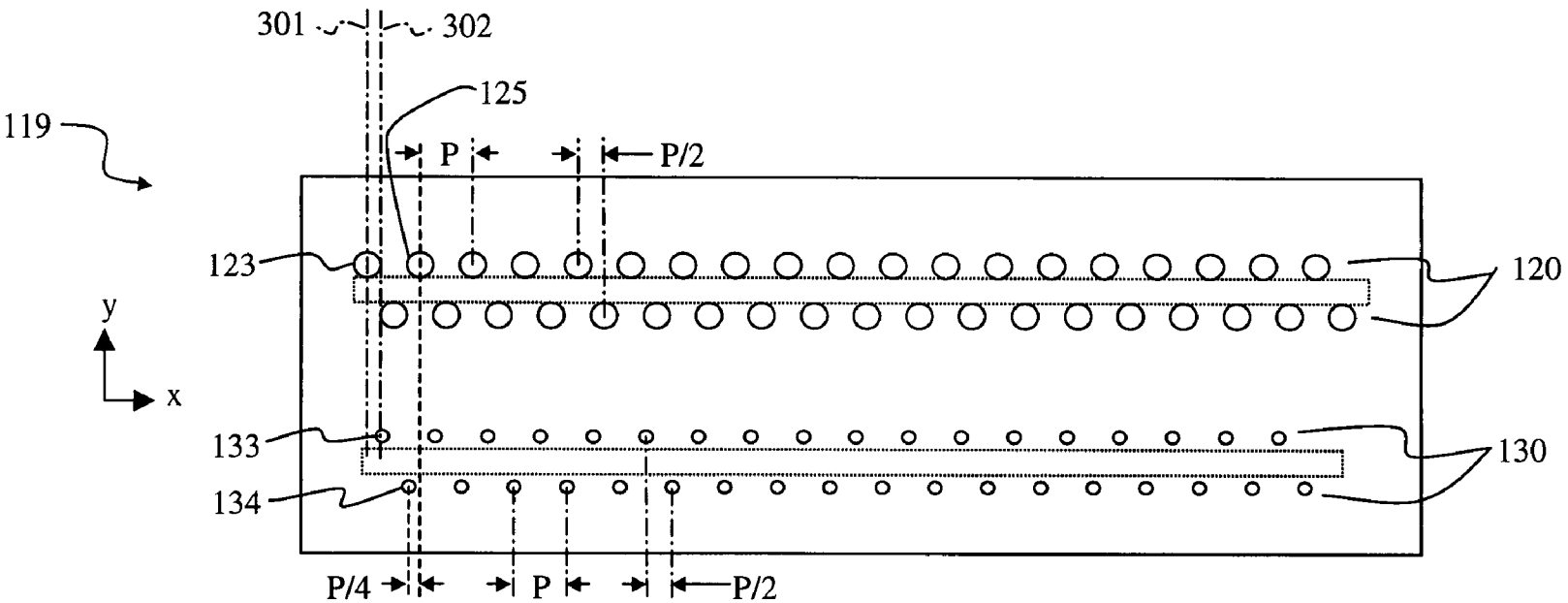
FIG. 12 is a top view of a fluid ejection device having some overlap between corresponding nozzles from the two offset arrays.

FIG. 12 shows a fluid ejection device 119 in which there is some overlap in the x direction between nozzles of array 120 and array 130. In FIG. 12, measuring from the dashed reference line through the center of nozzle 125 to the dashed reference line through the center of nozzle 134 gives the offset in the x direction of P/4 between nozzle array 120 and nozzle array 130. Reference line 301 is drawn in the y direction through the center of nozzle 123 and reference line 302 is drawn in the y direction through the outside edge of nozzle 123. Note that nozzle 133 lies partly between reference lines 301 and 302. In other words, there is overlap in the x direction between nozzle 123 and nozzle 133. For the case of circular nozzle 123 having diameter D and circular nozzle 133 having diameter d, with offset P/4 between them, overlap will occur if $P/4<(D+d)/2$. For the case of noncircular nozzles, there are similar relationships between array offset and nozzle extent in the x direction which determine whether there is overlap between nozzles in the two arrays. Nozzle overlap can be useful in some applications of fluid ejection devices and printheads to ensure that there will be overlap between drops ejected by the two different arrays (when the recording medium 20 is moved relative to the printhead, and there are suitable firing delays between the two arrays). However, depending partly on the spreading characteristics of the ejected fluids, in other applications it may not be desirable to have nozzle overlap between the two arrays.

Figure 13:
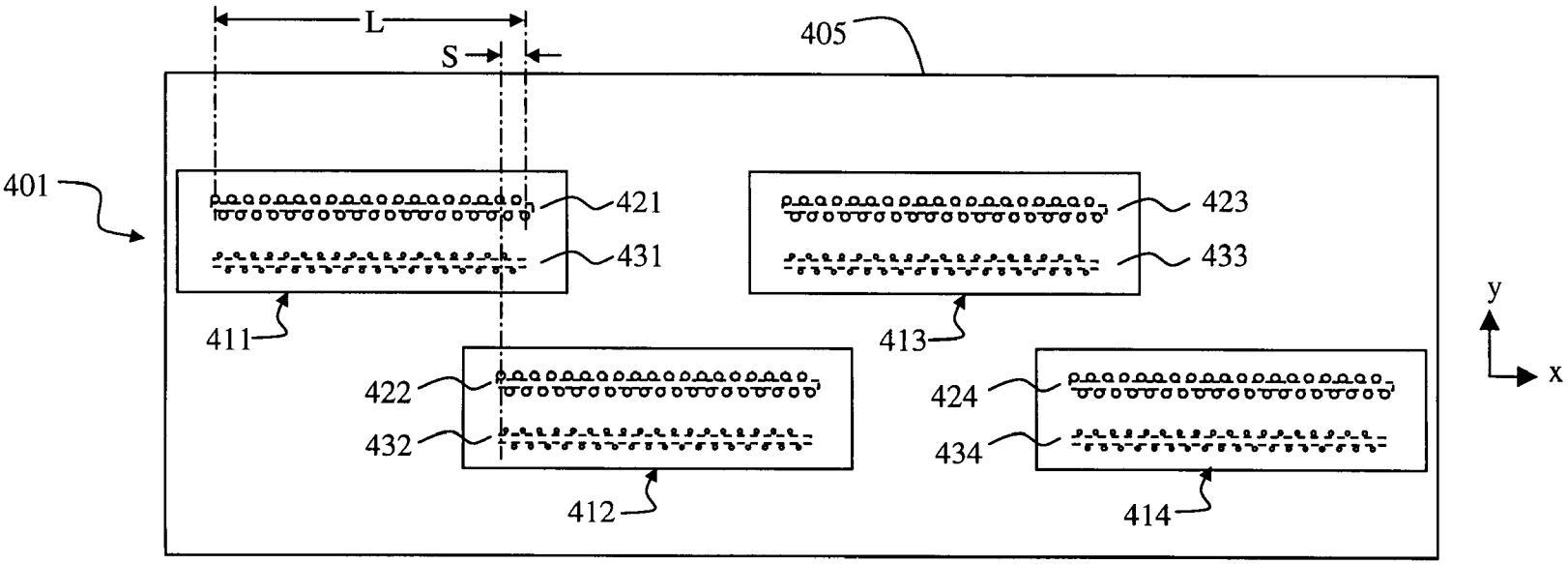
FIG. 13 is a top view of a printhead having a two-dimensional arrangement of fluid ejection devices, each having two offset nozzle arrays having different opening areas.

The printhead configurations described so far are arranged with the fluid ejection devices substantially side by side, offset from one another in the y direction (that is, offset in a direction perpendicular to the array direction). FIG. 13 shows another printhead configuration 401 where fluid ejection devices 411, 412, 413 and 414 are fixedly attached to support member 405 and are spaced apart from one another in order to provide a printhead with a larger printing zone than is possible using a single fluid ejection device. Fluid ejection device 411 has an array 421 of larger nozzles and an array 431 of smaller nozzles which is offset in the x direction from array 421 by a distance which is less than the nozzle pitch of array 421. The nozzle arrays are arranged along the corresponding fluid delivery pathways. Fluid ejection devices 412, 413 and 414 are configured similarly. The fluid ejection devices are arranged in staggered fashion with devices 411 and 413 being in one row (offset from one another in x, but not in y), and devices 412 and 414 being in a second row. Adjacent devices such as 411 and 412 have some amount of overlap of the nozzle arrays. Nozzle array 421 is shown as having a length L. The amount of overlap between nozzle array 421 on fluid ejection device 411 and nozzle array 422 on fluid ejection device 412 is S. Typically it will be advantageous to overlap by a few nozzles, but S will preferably be less than L/4. In this way an extended printing zone is provided with overlap between adjacent fluid ejection devices. In many such extended printing zone applications, it will be advantageous to have the same type of fluid delivered to corresponding nozzle arrays on each of the fluid ejection devices. For example, a black text ink might be delivered to nozzle arrays 421, 422, 423 and 424, while a photo black ink might be delivered to nozzle arrays 431, 432, 433 and 434.

Other variations of printhead 401 are contemplated but not shown. Although only four fluid ejection devices are shown in FIG. 13 (two in each row), a longer printing zone can be provided by having more fluid ejection devices in each row. Also, by providing additional rows, a printhead can be made capable of printing a greater number of fluids along the entire printing zone. Alternatively, greater redundancy for printing the same fluids can be provided. Although the fluid ejection devices in FIG. 13 are shown as having two nozzle arrays each, a further alternative is to use fluid ejection devices having additional nozzle arrays.

The invention has been described in detail with particular reference to certain preferred embodiments thereof, but it will be understood that variations and modifications can be effected within the spirit and scope of the invention.

PARTS LIST

In the following list, parts having similar functions in the various figures are numbered similarly.

10 fluid ejection system
12 image data source
14 controller
16 electrical pulse source
18 first fluid source
19 second fluid source
20 recording medium
100 ink jet printhead
101 ink jet printhead with three fluid ejection devices
102 ink jet printhead with four fluid ejection devices
103 ink jet printhead with three fluid ejection devices, one being rotated
104 ink jet printhead with two fluid ejection devices
105 ink jet printhead with one fluid ejection device
110 fluid ejection device with two slot-fed offset nozzle arrays
111 substrate
112 isolation layer
113 layers forming drop generator
114 heater corresponding to nozzle in first nozzle array
115 heater corresponding to nozzle in second nozzle array
116 fluid ejection device with two edge-fed offset nozzle arrays
117 fluid ejection device with one slot-fed and one edge-fed offset nozzle array
118 fluid ejection device with three nozzle arrays
119 fluid ejection device with overlap between corresponding nozzles
120 first nozzle array
**120*a*** first nozzle group in first nozzle array
**120*b*** second nozzle group in first nozzle array
121 nozzle in first nozzle array
122 fluid delivery pathway for first nozzle array
123 first nozzle in first nozzle group in first nozzle array
124 first nozzle in second nozzle group in first nozzle array
125 second nozzle in first nozzle group in first nozzle array
128 fluid delivery slot for first nozzle array
129 fluid channel for a first nozzle array
130 second nozzle array
**130*a*** first nozzle group in second nozzle array
**130*b*** second nozzle group in second nozzle array
131 nozzle in second nozzle array
132 fluid delivery pathway for second nozzle array
133 first nozzle in first nozzle group in second nozzle array
134 first nozzle in second nozzle group in second nozzle array
138 fluid delivery slot for second nozzle array

139 fluid channel for a second nozzle array
140 third nozzle array
148 fluid delivery slot for third nozzle array
150 nozzle plate layer
151 chamber forming layers
152 chamber
181 droplet ejected from first nozzle array
182 droplet ejected from second nozzle array
205 support member for fluid ejection devices in printhead
211 first fluid ejection device with two nozzle arrays in printhead
212 second fluid ejection device with two nozzle arrays in printhead
213 third fluid ejection device with two nozzle arrays in printhead
214 first fluid ejection device with three nozzle arrays in printhead
215 second fluid ejection device with three nozzle arrays in printhead
216 single fluid ejection device in printhead
221 first nozzle array on first two-array fluid ejection device in printhead
222 first nozzle array on second two-array fluid ejection device in printhead
223 first nozzle array on third two-array fluid ejection device in printhead
224 first nozzle array on first three-array fluid ejection device in printhead
225 first nozzle array on second three-array fluid ejection device in printhead
226 first nozzle array on six-array fluid ejection device in printhead
227 nozzle array on six-array fluid ejection device in printhead
231 second nozzle array on first two-array fluid ejection device in printhead
232 second nozzle array on second two-array fluid ejection device in printhead
233 second nozzle array on third two-array fluid ejection device in printhead
234 second nozzle array on first three-array fluid ejection device in printhead
235 second nozzle array on second three-array fluid ejection device in printhead %
236 second nozzle array on six-array fluid ejection device in printhead
237-239 nozzle arrays on six-array fluid ejection device in printhead
244 third nozzle array on first three-array fluid ejection device in printhead
245 third nozzle array on second three-array fluid ejection device in printhead
261-263 fluid delivery slots for first nozzle array on fluid ejection device
271-273 fluid delivery slots for second nozzle array on fluid ejection device
280 fluid delivery holes in support member
281-283 fluid sources
291-293 fluid sources
301 reference line through center of a nozzle
302 reference line through outside edge of the nozzle
305 support member for fluid ejection devices in a printhead
311-314 fluid ejection devices in a printhead
351-354 fluid sources each of which supplies both slots on a fluid ejection device
361-364 fluid delivery slots for first nozzle arrays
371-374 fluid delivery slots for second nozzle arrays
401 printhead having two dimensional arrangement of fluid ejection devices
405 support member for two dimensional arrangement of fluid ejection devices
411-414 fluid ejection devices in two dimensional arrangement
421-424 first nozzle arrays on fluid ejection devices
431-434 second nozzle arrays on fluid ejection devices

What is claimed is:

1. A fluid ejection device comprising:

a substrate comprising:

a first fluid delivery pathway;

a second fluid delivery pathway;

a first nozzle array in fluid communication with the first fluid delivery pathway, the first nozzle array including a plurality of nozzles arranged in a first nozzle group at a pitch P and in a second nozzle group at the pitch P, the first group and the second group extending in a first direction along the first nozzle array, the first group being spaced apart from the second group in a second direction, each of the plurality of nozzles of the first nozzle array having a first opening area; and a second nozzle array in fluid communication with the second fluid delivery pathway, the second nozzle array including a plurality of nozzles arranged in a first nozzle group at the pitch P and a second nozzle group at the pitch P, the first group and the second group extending in the first direction, the first group being spaced apart from the second group in the second direction, each of the plurality of nozzles of the second nozzle array having a second opening area, the second opening area being less than the first opening area, the nozzles of the first nozzle group and the second nozzle group of the second nozzle array being offset by a distance of P/4 in the first direction when compared to the first nozzle group of the first nozzle array and the second nozzle group of the first nozzle array.

2. The fluid ejection device according to claim 1, the first fluid delivery pathway comprising a channel extending in the first direction, the channel being positioned between the first nozzle group of the first nozzle array and the second nozzle group of the first nozzle array, wherein the channel is in fluid communication with a plurality of nozzles of the first nozzle group of the first nozzle array and the second nozzle group of the first nozzle array.

3. The fluid ejection device according to claim 2, wherein the nozzles of the second nozzle group of the first nozzle array are offset from the nozzles of the first nozzle group of the first nozzle array by a distance of P/2 in the first direction.

4. The fluid ejection device according to claim 1, the second fluid delivery pathway comprising a channel extending in the first direction, the channel being positioned between the first nozzle group of the second nozzle array and the second nozzle group of the second nozzle array, wherein the channel is in fluid communication with a plurality of nozzles of the first nozzle group of the second nozzle array and the second nozzle group of the second nozzle array.

5. The fluid ejection device according to claim 4, wherein the nozzles of the second nozzle group of the second nozzle array are offset from the nozzles of the first nozzle group of the second nozzle array by a distance of P/2 in the first direction.

6. The fluid ejection device according to claim 1, further comprising a drop forming mechanism operatively associated with each of a plurality of nozzles of the first nozzle array and each of a plurality of nozzles of the second nozzle array.

7. The fluid ejection device according to claim 6, wherein the drop forming mechanism comprises a piezoelectric actuator.

8. The fluid ejection device according to claim 6, wherein the drop forming mechanism comprises a thermal actuator.

9. The fluid ejection device according to claim 6, wherein the drop forming mechanism comprises a resistive heating element.

10. The fluid ejection device according to claim 6, wherein the drop forming mechanism is operatively associated with each of the plurality of nozzles of the first nozzle array and each of the plurality of nozzles of the second nozzle array such that a drop volume of the fluid ejected by the plurality of nozzles of the first nozzle array is about 1.3 to about 5 times greater than a drop volume of the fluid ejected by the plurality of nozzles of the second nozzle array.

11. A fluid emitter comprising a plurality of fluid ejection devices as claimed in claim 1.

12. The fluid ejection device according to claim 1, the offset distance being measured from a center point of the nozzle of the first array to a center point of the nozzle of the second array, wherein the opening area of at least one nozzle of the first array overlaps the opening area of at least one nozzle of the second array.

13. A printhead comprising:

a plurality of fluid ejection devices arranged on a support member, each fluid ejection device comprising:

a substrate including:

a first fluid delivery pathway;

a second fluid delivery pathway;

a first nozzle array in fluid communication with the first fluid delivery pathway, the first nozzle array including a plurality of nozzles arranged in a first nozzle group at a pitch P and in a second nozzle group at the pitch P, the first group and the second group extending in a first direction along the first nozzle array, the first group being spaced apart from the second group in a second direction, each of the plurality of nozzles of the first nozzle array having a first opening area;

a second nozzle array in fluid communication with the second fluid delivery pathway, the second nozzle array including a plurality of nozzles arranged in a first nozzle group at the pitch P and a second nozzle group at the pitch P, the first group and the second group extending in the first direction, the first group being spaced apart from the second group in the second direction, each of the plurality of nozzles of the second nozzle array having a second opening area, the second opening area being less than the first opening area, the nozzles of the first nozzle group and the second nozzle group of the second nozzle array being offset by a distance of P/4 in the first direction when compared to the first nozzle group of the first nozzle array and the second nozzle group of the first nozzle array;

a fluid source in fluid communication with each of the first and second fluid delivery pathways of each of the fluid ejection devices; and a drop forming mechanism operatively associated with each of a plurality of nozzles of the first nozzle array and each of a plurality of nozzles of the second nozzle array.

14. The printhead according to claim 13, wherein the plurality of fluid ejection devices have equivalent nozzle layouts.

15. The printhead according to claim 13, wherein the plurality of fluid ejection devices are arranged on the support member displaced from each other in the second direction.

16. The printhead according to claim 15, wherein the plurality of fluid ejection devices are arranged such that each first and second nozzle array of each ejection device have an equivalent orientation.

17. The printhead according to claim 13, wherein the fluid source in fluid communication with the first fluid delivery pathway and the fluid source in fluid communication with the second fluid delivery pathway of at least one fluid ejection device of the plurality of fluid ejection devices supply distinct fluids to the corresponding first and second nozzle arrays.

18. The printhead according to claim 13, wherein the fluid source in fluid communication with the first fluid delivery pathway and the fluid source in fluid communication with the second fluid delivery pathway of at least one fluid ejection device of the plurality of fluid ejection devices supply a similar fluid to the corresponding first and second nozzle arrays.

19. The printhead according to claim 13, wherein the fluid source in fluid communication with the first fluid delivery pathway and the fluid source in fluid communication with the second fluid delivery pathway of at least one fluid ejection device of the plurality of fluid ejection devices are a single fluid source and supply an identical fluid to the corresponding first and second nozzle arrays.

20. The printhead according to claim 13, wherein the drop forming mechanism comprises a piezoelectric actuator.

21. The printhead according to claim 13, wherein the drop forming mechanism comprises a thermal actuator.

22. The printhead according to claim 13, wherein the drop forming mechanism comprises a resistive heating element.

23. The printhead according to claim 13, wherein the drop forming mechanism is operatively associated with each of the plurality of nozzles of the first nozzle array and each of the plurality of nozzles of the second nozzle array such that a drop volume of the fluid ejected by the plurality of nozzles of the first nozzle array is about 1.3 to about 5 times greater than a drop volume of the fluid ejected by the plurality of nozzles of the second nozzle array.

24. The printhead according to claim 13, wherein the fluid source in fluid communication with the first fluid delivery pathway and the fluid source in fluid communication with the second fluid delivery pathway of at least one fluid ejection device of the plurality of fluid ejection devices supply distinct black inks to the corresponding first and second nozzle arrays.

25. The printhead according to claim 13, wherein the fluid source in fluid communication with the first fluid delivery pathway and the fluid source in fluid communication with the second fluid delivery pathway of at least one fluid ejection device of the plurality of fluid ejection devices supply similar black inks to the corresponding first and second nozzle arrays.

26. The printhead according to claim 13, wherein the fluid source in fluid communication with the first fluid delivery pathway of one of the plurality of fluid ejection devices supplies a colorless fluid to the corresponding first nozzle array.

27. The printhead according to claim 26, wherein the colorless fluid is a protective fluid.

28. The printhead according to claim 26, wherein the corresponding first nozzle array is an endmost array of the printhead.

29. The printhead according to claim 13, wherein the fluid source in fluid communication with the first fluid delivery pathway of one of the plurality of fluid ejection devices supplies a yellow ink to the corresponding first nozzle array.

30. The printhead according to claim 29, wherein the fluid source in fluid communication with the second fluid delivery pathway of one of the plurality of fluid ejection devices supplies a cyan ink to the corresponding second nozzle array.

31. The printhead according to claim 29, wherein the fluid source in fluid communication with the second fluid delivery pathway of one of the plurality of fluid ejection devices supplies a magenta ink to the corresponding second nozzle array.

32. The printhead according to claim 13, wherein the fluid source in fluid communication with the first fluid delivery pathway supplies a first black ink to the corresponding first nozzle array of a first fluid ejection device and the fluid source in fluid communication with the second fluid delivery pathway supplies a second black ink to the corresponding second nozzle array of a first fluid ejection device;

the fluid source in fluid communication with the first fluid delivery pathway supplies a yellow ink to the corresponding first nozzle array of a second fluid ejection device and the fluid source in fluid communication with the second fluid delivery pathway supplies one of a cyan and magenta ink to the corresponding second nozzle array of a second fluid ejection device; and the fluid source in fluid communication with the first fluid delivery pathway supplies a colorless fluid to the corresponding first nozzle array of a third fluid ejection device and the fluid source in fluid communication with the second fluid delivery pathway supplies the other of a cyan and magenta ink to the corresponding second nozzle array of a third fluid ejection device.

33. The printhead according to claim 13, wherein at least one of the fluid sources in fluid communication with at least one of the first fluid delivery pathway and the second fluid delivery pathway of at least one fluid ejection device of the plurality of fluid ejection devices supplies fluid comprising a colorant other than cyan, magenta, yellow, and black.

34. The printhead according to claim 13, wherein at least one of the fluid sources comprises a pigment based ink.

35. The printhead according to claim 13, wherein the fluid source in fluid communication with the first fluid delivery pathway comprises a first pigment based fluid having a first particle size and the fluid source in fluid communication with the second fluid delivery pathway comprises a second pigment based fluid having a second particle size, the first particle size being greater than the second particle size.

36. The printhead according to claim 13, wherein one of the plurality of fluid ejection devices is arranged on the support member such that at least one nozzle of one of the first nozzle array and the second nozzle array is offset in the first direction by a distance less than pitch P when compared to a corresponding nozzle of another of the plurality of fluid ejection devices arranged on the support member.

37. The printhead according to claim 13, the offset distance being measured from a center point of the nozzle of the first array to a center point of the nozzle of the second array, wherein the opening area of at least one nozzle of the first array overlaps the opening area of at least one nozzle of the second array.

38. The printhead according to claim 13, the fluid source in fluid communication with the first fluid delivery pathway comprising a first fluid and the fluid source in fluid communication with the second fluid delivery pathway comprising a second fluid, wherein the first fluid is less visibly perceivable than the second fluid.

39. The printhead according to claim 13, wherein at least one of the plurality of fluid ejection devices is arranged on the support member such that the second nozzle array is positioned adjacent to a second nozzle array of another of the plurality of fluid ejection devices.

40. The printhead according to claim 13, wherein at least one of the fluid ejection devices comprises a third nozzle array spaced apart from the second nozzle array in the second direction; and a third fluid delivery pathway in fluid communication with the third nozzle array.

41. The printhead according to claim 40, wherein at least a plurality of the nozzles of the third array have an opening area that is substantially equivalent to one of the opening area of the nozzles of the first array and the opening area of the nozzles of the second array.

42. The printhead according to claim 40, wherein nozzles of the second nozzle array and third nozzle array are spaced along the second nozzle array and the third nozzle array, respectively, at a pitch equal to the pitch P of the first nozzle array.

43. The printhead according to claim 42, wherein at least one nozzle of the third array is arranged offset in the first direction from one of at least one nozzle of the first array and at least one nozzle of the second array by a distance which is less than pitch P.

44. The printhead according to claim 40, wherein at least one nozzle of the third array is arranged offset in the first direction from one of at least one nozzle of the first array and at least one nozzle of the second array by a distance which is less than pitch P.

45. The printhead according to claim 13, wherein the fluid source in fluid communication with the first delivery pathway is removably associated with the first fluid delivery pathway and the fluid source in fluid communication with the second fluid delivery pathway is removably associated with the second fluid delivery pathway.

46. The printhead according to claim 13, the first nozzle array of one of the plurality of fluid ejection devices extending along the first direction and having a length L, wherein at least some of the plurality of fluid ejection devices are arranged on the support member offset from each other in the first direction such that nozzle arrays of adjacent fluid ejection devices overlap each other by less than 25% of the length L of each nozzle array.

47. A printhead comprising:

a fluid ejection device arranged on a support member, the fluid ejection device comprising:

a substrate including:

a first fluid delivery pathway;

a second fluid delivery pathway;

a first nozzle array in fluid communication with the first fluid delivery pathway, the first nozzle array including a plurality of nozzles arranged in a first nozzle group at a pitch P and in a second nozzle group at the pitch P, the first group and the second group extending in a first direction along the first nozzle array, the first group being spaced apart from the second group in a second direction, each of the plurality of nozzles of the first nozzle array having a first opening area;

a second nozzle array in fluid communication with the second fluid delivery pathway, the second nozzle array including a plurality of nozzles arranged in a first nozzle group at the pitch P and a second nozzle group at the pitch P, the first group and the second group extending in the first direction, the first group being spaced apart from the second group in the second direction, each of the plurality of nozzles of the second nozzle array having a second opening area, the second opening area being less than the first opening area, the nozzles of the first nozzle group and the second nozzle group of the second nozzle array being offset by a distance of P/4 in the first direction when compared to the first nozzle group of the first nozzle array and the second nozzle group of the first nozzle array;

a fluid source in fluid communication with each of the first and second fluid delivery pathways of the fluid ejection device; and a drop forming mechanism operatively associated with each of a plurality of nozzles of the first nozzle array and each of a plurality of nozzles of the second nozzle array.

48. The printhead according to claim 47, the offset distance being measured from a center point of the nozzle of the first array to a center point of the nozzle of the second array, wherein the opening area of at least one nozzle of the first array overlaps the opening area of at least one nozzle of the second array.

* * * * *